US009972292B2

(12) United States Patent
Good

(10) Patent No.: US 9,972,292 B2
(45) **Date of Patent: *May 15, 2018**

(54) PRECISION DRUM HOOP DEVICES AND METHODS

(71) Applicant: Drum Workshop, Inc., Oxnard, CA (US)

(72) Inventor: John J. Good, Thousand Oaks, CA (US)

(73) Assignee: DRUM WORKSHOP, INC., Oxnard, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/205,241

(22) Filed: Jul. 8, 2016

(65) Prior Publication Data

US 2016/0322036 A1 Nov. 3, 2016

Related U.S. Application Data

(63) Continuation-in-part of application No. 13/694,519, filed on Dec. 10, 2012, now Pat. No. 9,390,692, which is a continuation-in-part of application No. 13/317,810, filed on Oct. 28, 2011, now Pat. No. 8,563,841.

(51) Int. Cl.
*G10D 13/02* (2006.01)
*B21D 53/16* (2006.01)

(52) U.S. Cl.
CPC ..... *G10D 13/023* (2013.01); *B21D 53/16* (2013.01)

(58) Field of Classification Search
CPC ..... B21D 53/16; G10D 13/02
See application file for complete search history.

(56) References Cited

U.S. PATENT DOCUMENTS

| | | | | |
|---|---|---|---|---|
| 887,016 | A | 5/1908 | Poland | 84/411 R |
| 4,416,181 | A | 11/1983 | Hartry | 84/272 |
| 5,309,811 | A * | 5/1994 | Hoshino | G10D 13/026 248/220.21 |
| 7,313,941 | B1 * | 1/2008 | Chuang | B21D 5/08 72/307 |
| 7,361,823 | B2 | 4/2008 | Rush | 84/411 R |
| 7,786,363 | B1 * | 8/2010 | Wei | G10D 13/023 84/411 R |
| 8,563,841 | B1 | 10/2013 | Good | 84/411 R |
| 2013/0269819 | A1 | 10/2013 | Ruby et al. | 138/141 |

* cited by examiner

*Primary Examiner* — Kimberly Lockett
(74) *Attorney, Agent, or Firm* — Koppel, Patrick, Heybl & Philpott

(57) ABSTRACT

A method of forming a drum hoop is described and shown. The method can include forming connecting portions into ends of a strip of hoop material. The strip of hoop material can then be rolled such that the connecting portions interconnect. The method can also include forming an elongated edge of the strip and/or hoop of material into a rolled bend, such as a rolled bend toward the outside of the hoop. Finally, the method can include leveling the top and/or bottom surfaces of the hoop, such as leveling the rolled bend. This leveling can be accomplished by stamping one or both of the top and bottom surfaces of the hoop, the top surface in some embodiments being the top of the rolled bend.

35 Claims, 6 Drawing Sheets

PRECISION DRUM HOOP DEVICES AND METHODS

This application is a continuation-in-part of pending U.S. patent application Ser. No. 13/694,519 to Good for a "Precision True Hoop for Drum", filed on Dec. 10, 2012, which is a continuation-in-part of U.S. patent application Ser. No. 13/317,810 to Good for a "Safety Hoop for Drum", filed on Oct. 28, 2011, now U.S. Pat. No. 8,563,841. Each of the above two applications is fully incorporated by reference herein in its entirety.

BACKGROUND OF THE DISCLOSURE

Field of the Disclosure

This disclosure relates generally to the construction of drums, where drum sticks are used to strike hoops on the drums. More particularly, it concerns methods of construction of such hoops to avoid problems arising in their use.

This disclosure also relates to drum hoops such as snare drum hoops, and to methods for producing such hoops at a high level of precision not achieved by prior art methods.

Description of the Related Art

In the past, the configurations of drum hoops led to problems of hoop distortion during their bend-formation, and of drainage from under the hoops, and also to problems of interference with drums sticks, as during impact (rim shots). Such impact with hoop edges can cause severe damage to drum sticks. Also, water and other particles tended to accumulate under hoops. There is need for structural changes overcoming these and other problems and disadvantages.

Problems relating to distortion of such hoops during their construction and assembly using prior art methods has led to inaccuracy and difficulty in drum tuning.

SUMMARY OF THE DISCLOSURE

It is a major object of the disclosure to provide solutions to the above problems. Basically, the disclosure is embodied in drum structure formation, characterized by forming a strip of metal into a counter hoop to be supported by a drum shell proximate the drum head, and having a hoop shaped edge area formed to provide distortion free hoop structure and to resist or prevent drum stick damage, said forming including forming a reduced thickness bend proximate said edge area.

As will be seen, a gap is formed and located between the edge and the hoop side wall, the reduced thickness bend located at or near a hoop rolled outer surface spaced from the gap. The forming of reduced thickness is effected prior to forming of the strip of metal into hoop shape, and prior to forming of the bend, whereby resistance to hoop bending, and distortion, are reduced. Reduced thickness formation is effected by milling one side of the metal strip portion to be rolled. Another object is to provide the rolled configuration extending toward the outer side of the hoop, for gap concealment.

Further objects include provision of a hoop flange to be spaced from and in offset relation to the reduced thickness area, and provision of sideward projections integral with the hoop, and spaced from the rolled edge, the projections defining openings for drum tensioning rods.

An advantage to a top rolled hoop of reduced thickness is that it enables distortion free hoop bending, and leaves a smooth rounded surface for the drummer to strike the drumstick, on and without causing damage to the stick. The standard drum counter hoop has a straight edge or just a slight radius that causes severe damage to the stick as it is struck. Another advantage is strength, provided by rolling the top edge of the hoop, which increases strength and distortion free stability of the hoop. A further advantage is provision of a hoop edge that is flat upon hoop bending. With the rolled edge adding strength, the hoop will tend to stay in such flat condition, even under high tension.

Yet another object is to provide a drum shell having a reduced thickness edge rolled toward the outer side of the hoop, reducing hoop distortion.

An important object is to provide a method of drum structure distortion free formation, that includes the following steps:

1) provide flat elongated strip of metal, 2) locally mill a side portion of strip to provide reduced thickness along an edge portion of strip, 3) deform the elongated strip to provide sideward tuning projections spaced from the reduced thickness ledge portion of strip, and also to form a seating edge for engagement with a drum head annular rim, 4) roll the reduced thickness edge portion of the elongated strip to thereby form an elongated drum stick engaged rolled edge portion, or bend, such thickness reduction characterized as sufficient to prevent distortion of the hoop, out of annularity and to prevent distortion of said tuning projections during said rolling, and hoop bending, and 5) bend the thus formed metal strip into hoop shape.

In one embodiment of a method according to the present disclosure, a strip of metal comprising an elongated edge can be formed into a hoop. At least a portion of the elongated edge can be formed into a rolled bend, which can be leveled.

In another embodiment of a method according to the present disclosure, first and second connecting portions can be formed in first and second ends, respectively, of a substantially rectangular strip of hoop material having an elongated edge. The strip of hoop material can be rolled into a hoop such that the first and second connecting portions interlock, and the elongated edge can be formed into a rolled bend.

In yet another embodiment of a method according to the present disclosure, first and second ends of a strip of hoop material can be joined to as to form a hoop comprising an elongated top edge. The top of the hoop can be stamped so as to level it such that when the top of the hoop is placed on a flat surface and light shined from inside the hoop, substantially no visible light passes between the flat surface and the top of the hoop.

These and other objects and advantages of the disclosure, as well as the details of an illustrative embodiment, will be more fully understood from the following specification and drawings, in which:

DETAILED DESCRIPTION OF THE DISCLOSURE

Figure 1:
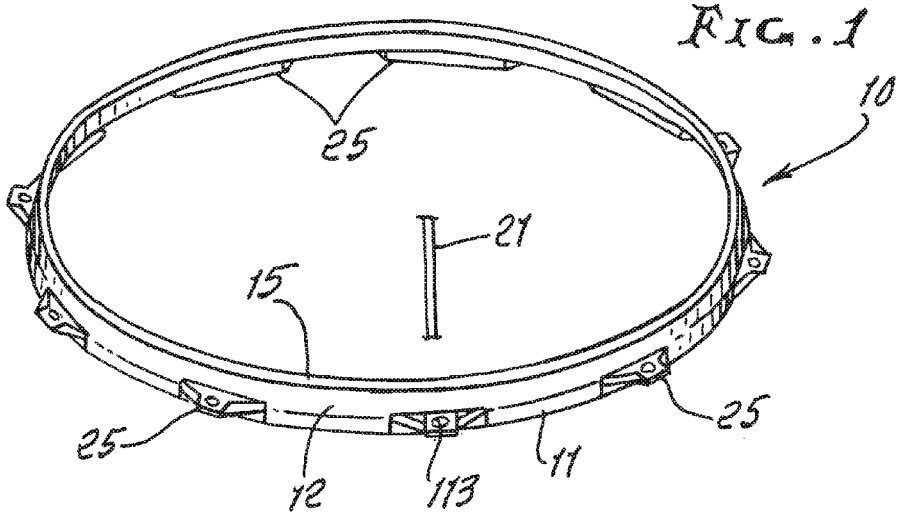
FIG. 1 is a perspective view of a drum hoop embodying the disclosure.
Figure 2:
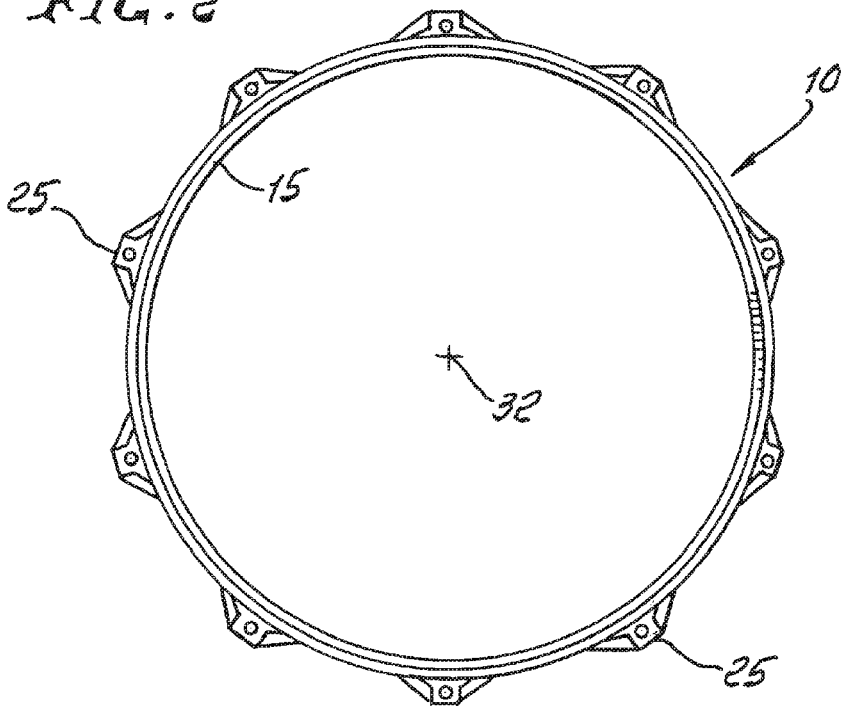
FIG. 2 is a plan view of the FIG. 1 hoop.

The present disclosure relates to drum and/or cymbal stands and assemblies, such as snare drum stands, and the snare drum stand baskets. Embodiments of the present disclosure can include features for enabling use with differently sized drums, allowing better sound quality due to a novel drum holding concept, and/or enabling easy compacting and/or storage.

The drum hoop 10 has metallic construction, with walls 11 and 12 offset to receive a drum wall 18 therebetween, i.e. beneath shoulder 13. Wall 12 has an upper edge 15 shaped to resist and prevent damage to a drum stick 17 which may at times impact that edge, during play. Edge 15 is shown, preferably, as rolled toward the outer side of the hoop, and to extend downwardly at 15*a*. The reduced thickness edge terminal 15*c*' faces inwardly toward wall 12, below ledge 15*g* with a small gap or opening 16 located between 15*c*' and wall 12, for water drainage. Outer side of wall 12 is shown at 15*b*. A typical thickness of wall 11 is about 2 millimeters.

Preferably, the edge portion 15*a* that is rolled is of substantially reduced thickness at t1 in FIG. 4*b*, leaving the main extent 12*a* of wall 12 of relatively un-reduced thickness at t2, below ledge 151*g*, in FIGS. 4 and 5. FIG. 4*b* shows the flat strip of material 15*c*, and milling tool 90 positioned to remove material at 15*d* leaving reduced thickness t1. The length of 15*a* of reduced thickness between 15*f* and ledge 15*g* locates ledge 15*g* above the level of terminal 15*f*. See also FIG. 4*c*, showing hoop formation bending in direction 110, about the hoop axis with substantially reduced resistance to bending being created due to reduced thickness at 15*a*, with less hoop distortion during hoop formation.

Location of gap 16, concealed and spaced below upper arcuate surface 15*e* and below ledge 15*g* prevents contact of the drum stick 17 with the terminal 15*f*, and any sharp edge thereof. Also, ledge 15*g* located as shown enables the approximately 180° rolled metallic extent at 15, 15*a* and 15*n* to have substantially reduced thickness relation to wall 11, to facilitate distortion free hoop formation.

A sideward projection 25 from the hoop provides an opening 113 for reception of a tensioning rod 21, in outwardly spaced relation from the gap 16. Space 112 between projection outer edge and through opening 113 that passes the tensioning rod, for tuning is kept constant.

A drum head is seen at 14, and a drum axis at 32. The method of drum distortion free formation includes the following steps:

1) provide flat elongated strip 15*c* of metal, 2) locally mill a side portion of strip with tool 90 to provide reduced thickness at 15*d* along an edge portion of strip, 3) deform the elongated strip to provide sideward tuning projections 25 spaced from the reduced thickness edge portion 15*a* of strip, and also to form a seating edge for engagement with a drum head annular rim 121, 4) roll the reduced thickness edge portion of the elongated strip to thereby form an elongated drum stick engaged or engaging rolled and arcuate edge portion, or bend, as at 15*e*, that thickness reduction characterized as sufficient to prevent distortion of the hoop out of annularity and to prevent distortion of the tuning projections 25 during such rolling, and hoop bending, and 5) bend the thus formed metal strip into hoop shape, with thickness reduction extending annularly.

Figure 6:
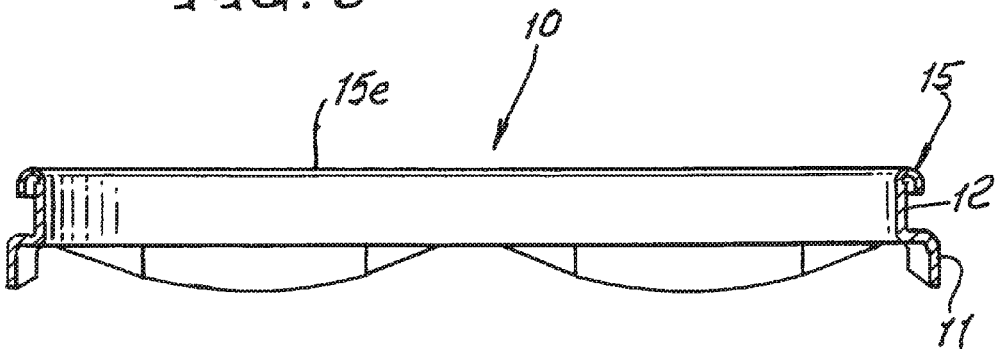
FIG. 6 shows a complete hoop, in section.

Milling the metal strip 15*c* prior to forming the hoop bend ensures that there are no distortions on the underside, top and bottom of the flanged projections 25, whereby they remain perpendicular to wall 12, and distortion free. Accordingly, the distance "d" from the end of the flanged ear or projections to the edge of the oval hole 113 that passes the tensioning rod 212 is consistently the same, at all of the flanged ears 25 around the hoop. The configuration of the channel ledge where the drum head 14 seats, is also consistently the same, around the hoop, whereby tuning of the drum is very simply optimized, and a true hoop configuration is achieved. FIG. 6 shows a completely formed hoop, in section.

Figure 7:
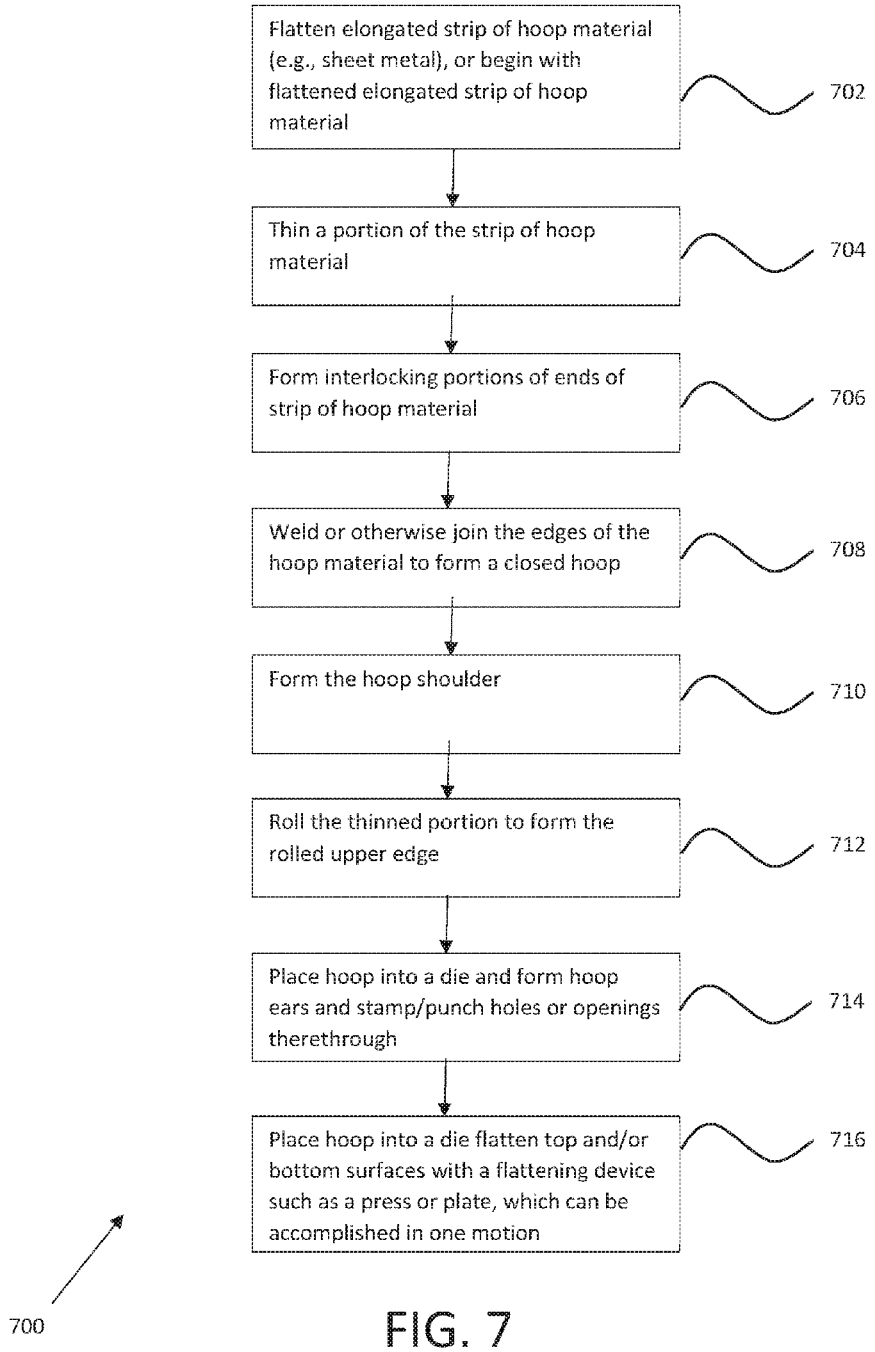
FIG. 7 shows a flowchart of a method according to one embodiment of the present disclosure.

Other methods of forming a drum hoop according to the present disclosure are also possible, and can include none, some, or all of the steps listed above, such as the steps 1-5. Some possible steps in embodiments of methods according to the present disclosure are shown in FIG. 7. It is understood that while the shown method 700 includes eight steps, additional steps may be included, or any one or more steps may be omitted. Further, while one particular order of steps is shown in FIG. 7, many different orders are possible, and the order shown should not be considered limiting in any way. Additionally, steps of the method 700 can be altered, and/or can be split into different sub-steps which may occur at the same or different times.

In the first step 702 of the method 700, the manufacturer can begin with an elongated strip of hoop material such as aluminum, sheet metal, steel, copper, wood, or another suitable material as known in the art. It is understood that while the phrase "elongated strip" is used throughout this disclosure, the strip may actually be square or could be rolled in the direction of the shorter dimension in certain embodiments.

The dimensions of the elongated strip of hoop material will depend upon the application of the final product to be formed. In one exemplary embodiment of a snare hoop formed by the method 700, the elongated strip of material can have a height of about 1" to 2", a length of about 35" to 50", and/or a thickness/width of about 1/16" to 1/8". It is understood that these dimensions are purely exemplary and that dimensions outside of these ranges are possible, and that dimensions can vary based upon the desired dimensions of the final hoop to be formed.

In the step 704, material can be thinned along one or both of the elongated edges of the strip, such as by milling, grinding, cutting, and/or other types of mechanical and/or chemical processes as are known in the art. Such thinning can assist with the rolling step 708, to be discussed below. In one exemplary embodiment of a snare hoop formed by the method 700, about 1/8" to 3/4", or about 3/8", of material along the elongated edge (e.g., in FIG. 4B, from the end of the material to the ledge 15*g*) can be thinned. In one embodiment, this distance is about 10-25% of the total height of the strip of material. In one embodiment, the material can be thinned such that $t_1$ in FIG. 4*b* is about half the distance of $t_2$, or is less than half the distance of $t_2$. In one embodiment, the material can be thinned to between about 1/32" and 1/16". It is understood that embodiments with dimensions outside the above ranges are possible and within the scope of the present disclosure.

Figure 8A:
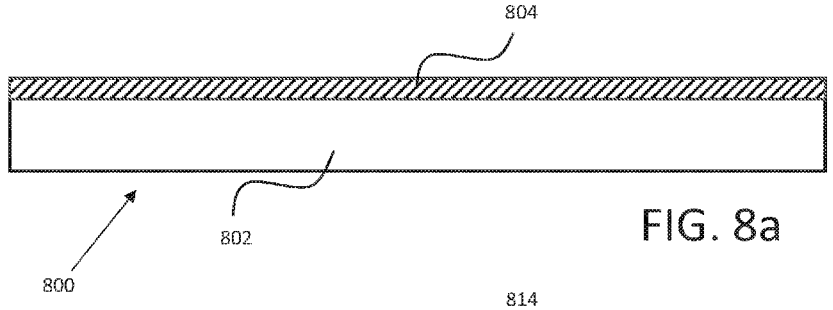
FIGS. 8*a*-8*d* are schematic views of hoop strips at various points of manufacturing methods according to embodiments of the present disclosure.
Figure 8B:
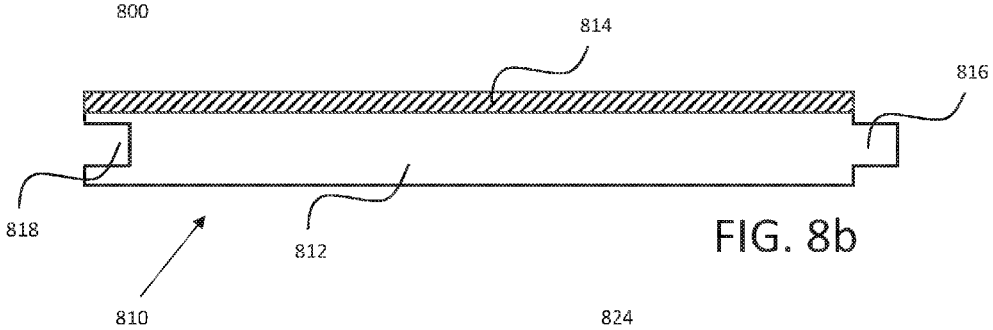
Figure 8C:
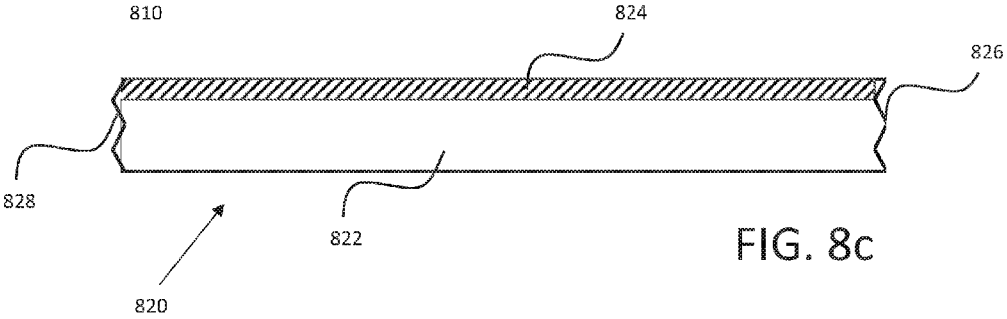
Figure 8D:
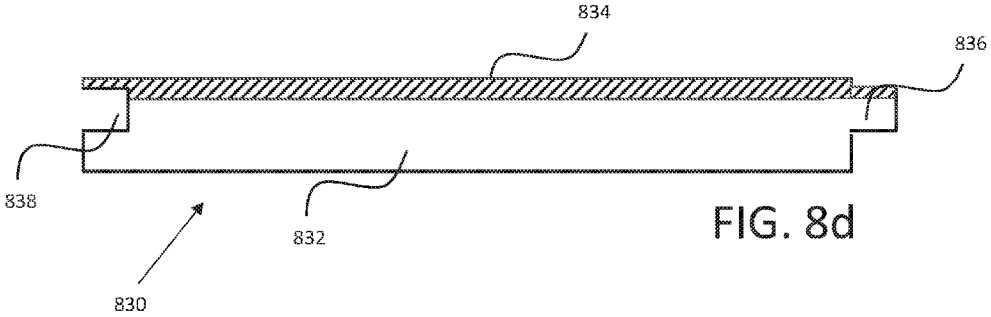

In the step 706, interlocking portions can be formed into a strip of hoop material. FIG. 8*a* is a schematic of a strip of hoop material 800 after having undergone steps 702 and 704 of the method 700, and including an unthinned portion 802 and a thinned portion (e.g., a thinned elongated edge) 804. The strip 800 can be modified to include a male connecting portion 816 and a female connecting portion 818, as shown by strip 810 in FIG. 8*b*. While the strip 810 includes a single male/female pair of connecting portions, other embodiments may have more. Another exemplary embodiment includes two male connecting portions similar to or the same as the male connecting portion 816, and two female connecting portions similar to or the same as the female connecting portion 818. For example, the ends 826, 828 of the strip 820 are jagged (resulting in multiple male/female connections). Connecting portions in embodiments of the present disclosure can be contained solely in the unthinned portion, solely in the thinned portion, or in both. For example, the male/female connections 816, 818 of the strip 810 in FIG. 8*b* are solely in the unthinned portion 812, while the jagged ends 816, 818 of the strip 820 in FIG. 8*c* are in both the unthinned portion 822 and the thinned portion 824. Similarly, the strip 830 in FIG. 8*d* includes a male portion 836 and female portion 839 which are in both the unthinned portion 832 and the thinned portion 834. Many different embodiments are possible.

In the step 708, the edges of the hoop material can be joined so as to form a closed hoop. To accomplish this, the hoop material can be rolled, such as about an object having an approximately constant radius, and the ends joined thereafter. This joining can include connecting portions, such as the male/female connecting portions described above with regard to FIGS. 8*b*-8*d*, or other types of connecting portions, or may not include any connecting portions and/or may be flush with one another (as shown in FIG. 8*a*). The joining of the two ends can be accomplished via, for example, welding, soldering, gluing, or other methods as known in the art.

Figure 4:
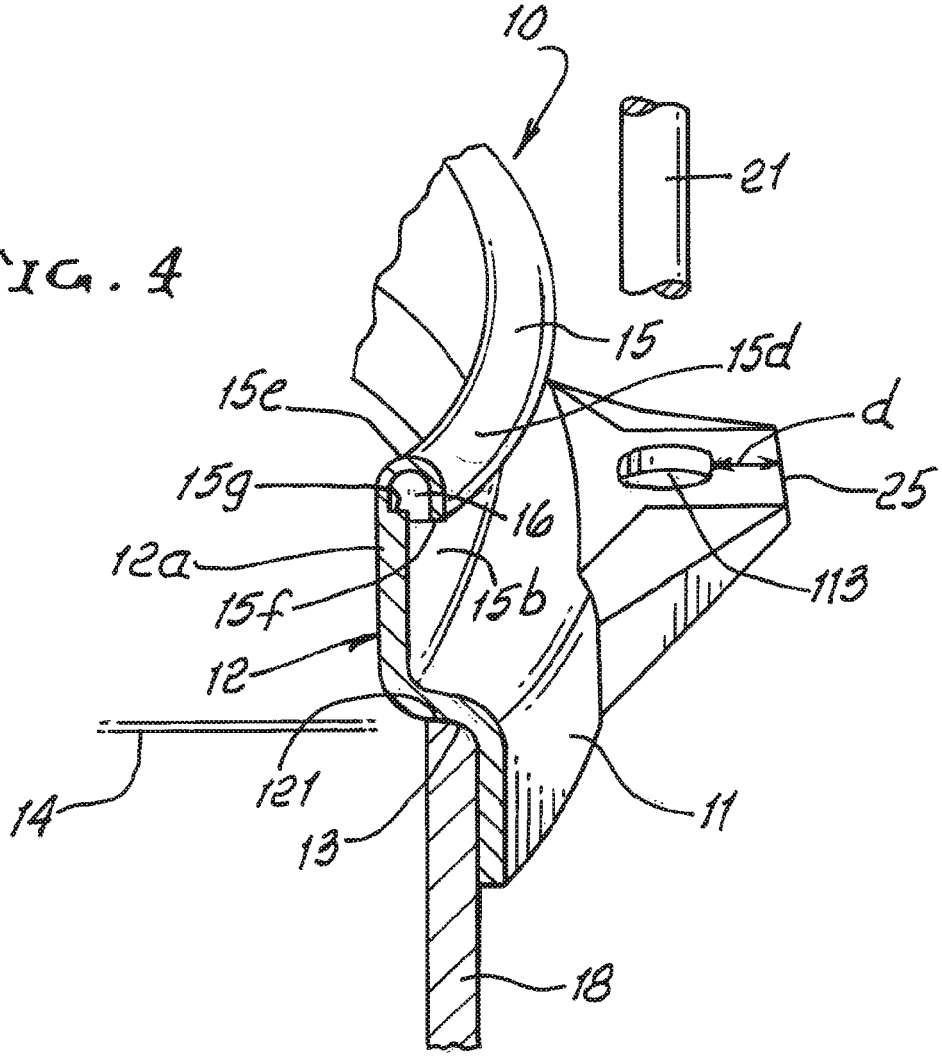
FIGS. 4 and 5 are enlarged fragmentary sections showing hoop construction.
Figure 4B:
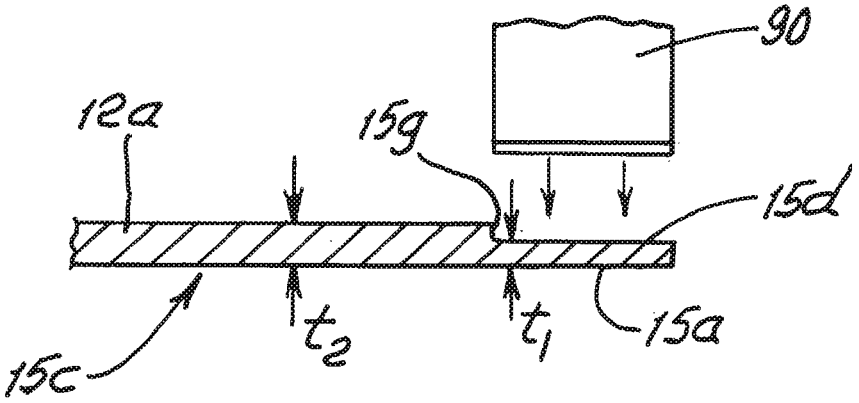
FIGS. 4*b*-4*c* are views showing processing of a hoop strip, prior to hoop formation.
Figure 4C:
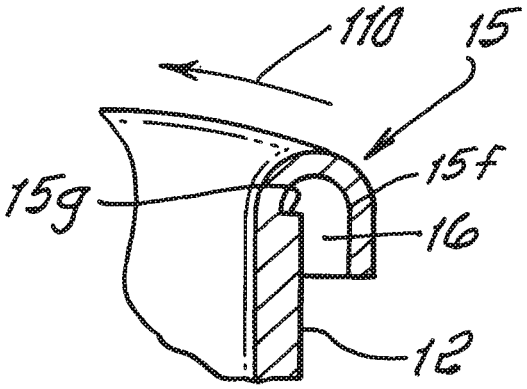
Figure 5:
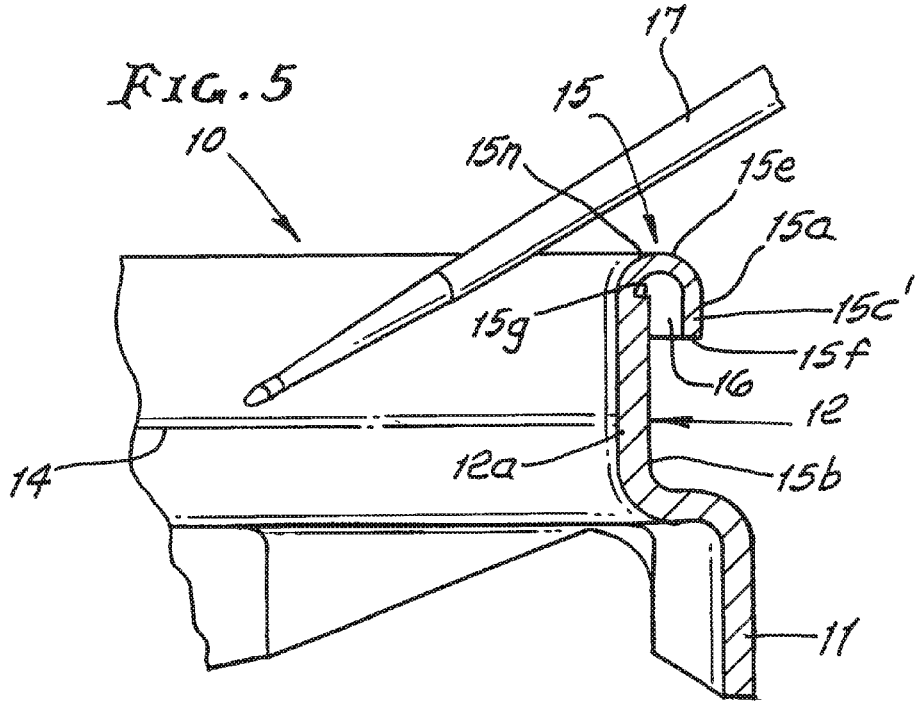

In the step 710, a shoulder such as the shoulder 13 shown in FIG. 4, can be formed. For example, in one method the hoop can be rolled about another object having a second radius larger than the object described above in the step 710. In another embodiment, the hoop of material can be rolled about a bearing which pushes a portion of the hoop outward to form the shoulder. In another possible method, after rolling of the strip of material into hoop shape as described above with regard to the step 708, the hoop shape of material can be stamped onto a template, altering the shape of the hoop so as to form the shoulder 13. In another possible embodiment, the rolling performed in the steps 708, 710 can be accomplished together, such as by rolling the hoop about an object having two different radii (one for the non-shoulder portion and one for the shoulder portion), and/or having a shape to match that of the shoulder (and thus having a transition between the inner radius and the outer radius). Many different embodiments are possible.

In the step 712, the elongated upper edge of the strip of hoop material can be rolled so as to form a rolled bend, such as that shown in FIG. 4*c*. In the embodiment shown in FIG. 4*c*, substantially none of the unthinned portion forms a part of the rolled bend, while substantially all of the thinned portion is a part of the rolled bend. In other embodiments, a portion of the unthinned portion may form a part of the rolled bend. In yet other embodiments, not all of the thinned portion will be a part of the rolled bend. Further, the strip of hoop material need not necessarily include a thinned portion in order to form the rolled bend or to complete the other steps shown in FIG. 7 and described herein. Further, while the rolled bend shown in FIG. 4 is shown as being rolled toward the outside of the hoop and toward the thinned side of the hoop (which can cover the ledge formed by the thinning), it is understand that it could be rolled toward the inside of the hoop and/or toward the unthinned side of the hoop. The rolled bend can be formed mechanically, and heating of the hoop material (e.g., heating above room temperature) may increase malleability so as to ease the work required for formation of the rolled bend. Heat can also be used in other steps described herein, such as the step 710 above, and can be especially applicable to steps requiring material deformation (e.g., deformation of a metal).

Figure 3:
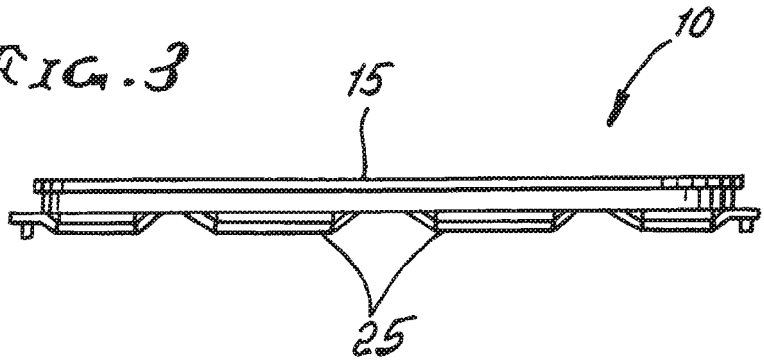
FIG. 3 is an edge view of the loop.

In the step 714, hoop ears can be formed into the hoop. FIGS. 3 and 4 show examples of some embodiments of such hoop ears 25. These hoop ears can be formed, for example, by stamping the hoop onto a template such that part of the bottom portion of the hoop is driven upwards to form a hoop ear 25 (note that "upwards" as used here uses the hoop as the frame of reference; the hoop could actually be placed upside down and the hoop ears pressed downwards). Before, after, or simultaneously with the formation of the hoop ears (preferably after or simultaneously with), openings can be formed through the hoop ears. For example, the same machine that alters the shape of the hoop material to form the hoop ears can also include a stamp portion to form openings therethrough. In practice, tension rods can later be passed through these hoop ears to prepare the drum for playing. In order to minimize the negative effects of a tension rod not being placed precisely, the hoop ears can be made to extend exactly or substantially exactly perpendicularly from the hoop. In another embodiment, the hoop ears can be made to extend substantially horizontally, and/or to extend substantially exactly horizontally. Prior to or as part of the step 714, the hoop can be placed into a die to facilitate the formation of the hoop ears and/or the stamping/punching of holes or openings therethrough.

Finally, the step 716 can allow for precision level surfaces which are much more precise than drum hoop surfaces formed by prior art methods. The top surface, bottom surface, or both the top and bottom surfaces can be leveled so as to form a hoop having precise top and bottom surfaces. Prior art hoop-forming processes can result in the top and/or bottom surfaces of the hoop, such as the top of the rolled bend shown in FIG. 4, being uneven and/or not level, and/or can result in undesired hoop height variance among different radial points. In particular, unevenness in the top and/or bottom surfaces of the hoop can be caused during formation of hoop ears, such as described with respect to the step 714. In the step 716, the near-finished hoop can be placed on a flat surface, or alternatively can be placed on a template or die fitting the hoop's shape (such as, for example, a template fitting the bottom and hoop ears of the hoop). The top and/or bottom hoop surfaces can then be leveled, such as by stamping. In one embodiment, a very heavy machine, such as a stamping machine, can be lowered onto the top or bottom of the hoop to level it. The flat surface upon which the hoop is placed can be hard, such that the side of the hoop being stamped (the top or bottom) and the other side of the hoop are both flattened. In one embodiment, a stamping machine is lowered quickly onto the top of the hoop so as to kiss its top surface, slightly altering the topography of the top surface and in some instances the bottom surface so as to level them. In another embodiment, both the top and bottom surfaces are leveled, as in some instances only stamping one of the top and bottom surfaces may not level both.

The top and/or bottom surfaces of the drum hoop and/or the rolled edge can be leveled to 1/32" or less variance between the highest and lowest points, and in some embodiments to 1/64" or less variance, and in some embodiments to 1/128" or less variance, and even further in some embodiments to 1/256" or less variance.

While in the above step 716 the hoop is stamped from one side against a static surface on its other side, it is understood that the hoop may be stamped from both the top and bottom either simultaneously or one after the other. In some embodiments, the flattening of both sides is achieved in one motion and/or simultaneously, such as through a sandwiching motion where both sides are stamped or a motion where one side is stamped against a surface.

One method of testing the precision leveling process is placing the hoop upside down on a flat surface (in on embodiment, such that a rolled bend is against the flat surface) and attempting to shine light between the flat surface and the hoop. With hoops formed according to some embodiments of the methods described herein, substantially no visible light shines between the flat surface and the hoop. Additionally, another method which can be used in conjunction with the above method or independently therefrom can include placing the hoop rightside up on a flat surface and attempting to shine light between the flat surface and the hoop. With hoops formed according to some embodiments of the methods described herein, substantially no visible light shines between the flat surface and the hoop, other than through the areas under and/or near the hoop ears.

It is understood that embodiments presented herein are meant to be exemplary. Embodiments of the present disclosure can comprise any combination of compatible features shown in the various figures, and these embodiments should not be limited to those expressly illustrated and discussed.

Although the present disclosure has been described in detail with reference to certain configurations thereof, other versions are possible. Therefore, the spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A method of forming a drum hoop, comprising:

forming a strip of hoop material comprising an elongated edge into a hoop;

forming at least a portion of said elongated edge into a rolled bend;

leveling said rolled bend; and forming a plurality of horizontal hoop ears extending from said hoop.

2. The method of claim 1, wherein said leveling comprises stamping said rolled bend.

3. The method of claim 1, further comprising placing said hoop on a flat surface prior to said leveling such that said rolled bend is at a top of said hoop.

4. The method of claim 1, wherein said forming of a strip of hoop material comprising an elongated edge into a hoop comprises:

forming at least one male connecting piece on a first end of said strip of hoop material; and forming at least one female connecting piece on a second end of said strip of hoop material.

5. The method of claim 4, further comprising joining said first and second ends of said strip of hoop material such that said at least one male connecting piece and said at least one female connecting piece interlock.

6. The method of claim 5, wherein said joining comprises welding.

7. The method of claim 1, further comprising thinning said elongated edge.

8. The method of claim 7, wherein said thinning comprises milling.

9. The method of claim 7, wherein said rolled bend is rolled toward the direction from which said thinning occurs.

10. The method of claim 1, wherein said hoop ears are formed prior to said leveling.

11. The method of claim 1, further comprising forming holes through said hoop ears simultaneously with the formation of said hoop ears.

12. The method of claim 11, wherein said hoop ears are formed to extend substantially perpendicularly from said hoop.

13. The method of claim 1, wherein said rolled bend is rolled approximately 180° so as to include a portion extending substantially vertically downward.

14. The method of claim 1, wherein said strip of hoop material comprises a bottom portion below said elongated edge; and further comprising forming said bottom portion into a shoulder, said shoulder having a larger radius than said elongated edge.

15. The method of claim 1, wherein said rolled bend is leveled such that when said rolled bend is placed adjacent a flat surface with a light source within said hoop, substantially no visible light shines between said rolled bend and said flat surface.

16. The method of claim 15, wherein said hoop comprises a bottom surface opposite said rolled bend, and further comprising leveling said bottom surface such that when said bottom surface is placed adjacent a flat surface with a light source within said hoop, substantially no visible light shines between said bottom surface and said flat surface other than visible light shining under or near said hoop ears.

17. The method of claim 1, wherein said rolled bend is rolled toward the outside of said hoop.

18. The method of claim 1, further comprising placing said hoop into a die or template prior to said leveling.

19. The method of claim 1, wherein said hoop comprises a bottom surface opposite said rolled bend;

further comprising leveling said bottom surface.

20. A method of forming a drum hoop, comprising:

forming a first connecting portion into a first end of an elongated strip of hoop material, said elongated strip of material comprising an elongated edge;

forming a second connecting portion into a second end of said elongated strip of hoop material, said second connecting portion corresponding to said first connecting portion;

rolling said elongated strip of hoop material into a hoop such that said first and second connecting portions interlock; and rolling said elongated edge into a rolled bend.

21. The method of claim 20, further forming a plurality of horizontal hoop ears extending from said hoop, each of said horizontal hoop ears with at least one hole therethrough, said holes formed simultaneously with said horizontal hoop ears.

22. The method of claim 20, further comprising stamping said rolled bend to level the top of said hoop.

23. A method of forming a drum hoop, comprising;

joining first and second ends of a strip of hoop material such that said strip of hoop material forms a hoop; and stamping a top of said hoop so as to level said top;

wherein when said top of said hoop is placed on a flat surface and light shined from inside said hoop, substantially no visible light passes between said flat surface and said top of said hoop.

24. The method of claim 23, wherein said top of said hoop comprise an elongated top edge, and further comprising forming said elongated top edge into a rolled bend prior to said stamping.

25. The method of claim 24, further comprising thinning said elongated top edge prior to forming said elongated top edge into a rolled bend.

26. The method of claim 23, further comprising stamping a bottom of said hoop so as to level said bottom;

wherein when said bottom of said hoop is placed on a flat surface and light shined from inside said hoop, substantially no visible light passes between said flat surface and said bottom of said hoop other than visible light shining under or near said hoop ears.

27. The method of claim 23, further comprising placing said top of said hoop on a flat surface and shining light from inside said hoop, wherein substantially no visible light passes between said flat surface and said top of said hoop.

28. A method of forming a drum hoop, comprising:

forming a strip of hoop material comprising an elongated edge into a hoop;

forming at least a portion of said elongated edge into a rolled bend;

placing said hoop into a die or template; and after placing said hoop into said die or template, levelling said rolled bend.

29. The method of claim 28, further comprising:

after placing said hoop into said die or template, forming a plurality of hoop ears extending horizontally from said hoop.

30. The method of claim 29, wherein each of said hoop ears includes at least one hole therethrough that is formed simultaneously with the rest of said hoop ear.

31. The method of claim 30, wherein said levelling comprises stamping.

32. The method of claim 31, wherein when said rolled bend is placed on a flat surface and light shined from inside said hoop, substantially no visible light passes between said flat surface and said rolled bend.

33. The method of claim 32, wherein said rolled bend is rolled approximately 180° so as to include a portion extending substantially vertically downward.

34. The method of claim 32, further comprising placing said rolled bend on a flat surface and shining light from inside said hoop, wherein substantially no visible light passes between said flat surface and said rolled bend.

35. The method of claim 28, wherein when said rolled bend is placed on a flat surface and light shined from inside said hoop, substantially no visible light passes between said flat surface and said rolled bend.

* * * * *